US006251024B1

(12) United States Patent
Summers et al.

(10) Patent No.: US 6,251,024 B1
(45) Date of Patent: Jun. 26, 2001

(54) JUMP TIP APPARATUS FOR POOL CUES

(76) Inventors: Kenneth E Summers, R.R. 1 Box 374, Bourbon, MO (US) 65441; Stephen A. Sewald, 872 Shady La., Sullivan, MO (US) 63080

( * ) Notice: Subject to any disclaimer, the term of this patent is extended or adjusted under 35 U.S.C. 154(b) by 0 days.

(21) Appl. No.: 08/496,757

(22) Filed: Jun. 29, 1995

(51) Int. Cl.[7] ..... A63B 67/00
(52) U.S. Cl. ..... 473/49; 473/44
(58) Field of Search ..... 473/FOR 46–49

(56) References Cited

U.S. PATENT DOCUMENTS

| | | | | |
|---|---|---|---|---|
| 743,041 | * | 11/1903 | Seelinger | 473/49 |
| 825,105 | * | 7/1906 | Borsdorf | 473/49 |
| 908,021 | * | 12/1908 | Marsh | 473/49 |
| 1,522,321 | * | 1/1925 | Nyhagen | 473/48 |
| 1,543,811 | * | 6/1925 | Wright | 473/49 |
| 3,204,961 | * | 9/1965 | Salamone | 473/49 |
| 3,580,576 | * | 5/1971 | Merola | 473/49 |
| 3,595,576 | * | 7/1971 | Gunia | 473/49 |
| 3,730,570 | * | 5/1973 | Brochstein | 473/49 |
| 5,462,490 | * | 10/1995 | Donwen | 473/49 |
| 5,478,282 | * | 12/1995 | Possum et al. | 473/48 |
| 5,938,536 | * | 8/1999 | Minke | 473/49 |
| 6,042,481 | * | 3/2000 | Walker et al. | 473/43 |

FOREIGN PATENT DOCUMENTS

| | | | | |
|---|---|---|---|---|
| 738297 | * | 7/1966 | (CA) | 473/47 |
| 573159 | * | 6/1924 | (FR) | 473/49 |
| 136731 | * | 12/1919 | (GB) | 473/49 |
| 208002 | * | 12/1923 | (GB) | 473/49 |
| 245676 | * | 4/1926 | (IT) | 473/49 |

* cited by examiner

*Primary Examiner*—Stephen F. Gerrity
*Assistant Examiner*—Mitra Aryanpour
(74) *Attorney, Agent, or Firm*—Paul M Denk

(57) ABSTRACT

A jump tip apparatus for pool cues having a ferrule end for releasable securement to the tip end of a pool cue in longitudinal alignment with the pool cue, and a resilient striking end in longitudinal alignement with the ferrule end. The resilient striking end having an annular ring on the striking end, with a concave depression extending within the annular ring. The striking end of the jump tip apparatus having a tapered angular profile extending exteriorily from the annular ring towards the ferrule end. The ferrule end of the jump tip apparatus may have external or internal threads sized to threadably engage existing threads on the tip end of the pool cue. Alternately, the ferrule end may be rigid or resilient, with an internal aperture sized to receive the tip end of the pool cue therein.

8 Claims, 2 Drawing Sheets

JUMP TIP APPARATUS FOR POOL CUES

BACKGROUND OF THE INVENTION

Pool and billiard players typically use a pool cue having a handle end and a tip end for shooting a cue ball into other balls for the purpose of hitting selected balls into pockets, or against table rails. At times, other balls are in the way. One known method of avoiding other balls, is the "jump shot".

Typically, the jump shot is performed by striking the cue ball at a sharply elevated angle with the cue tip. If properly executed, the cue ball jumps off the table, over the other balls to hit the desired ball in the intended direction. This takes considerable skill, and may damage the pool or billiard table, if the cue tip strikes the table surface, which is typically covered with a cloth material.

U.S. Pat. No. 1,123,807 discloses a detachable tip for billiard cues.

U.S. Pat. No. 1,605,240 discloses a cue tip which is placed over an existing cue tip.

SUMMARY OF THE INVENTION

Therefore, what is needed is a custom jump tip for pool cues, which will enable the user to strike the cue ball at a conventional angle, whereupon the cue ball will jump over a non-object ball to strike the object ball in the intended direction. The custom jump tip should be easy to install and remove, as it is only occasionally needed. Alternately, it may be permanently installed on a pool cue which has been "customized" exclusively for jump shots.

Other objects and features of the present invention will become apparent from a consideration of the following description which proceeds with reference to the accompanying drawings, wherein example embodiments of the invention are selected by way of illustration and not by way of restriction.

DETAILED DESCRIPTION OF THE PREFERRED EMBODIMENTS

Figure 1:
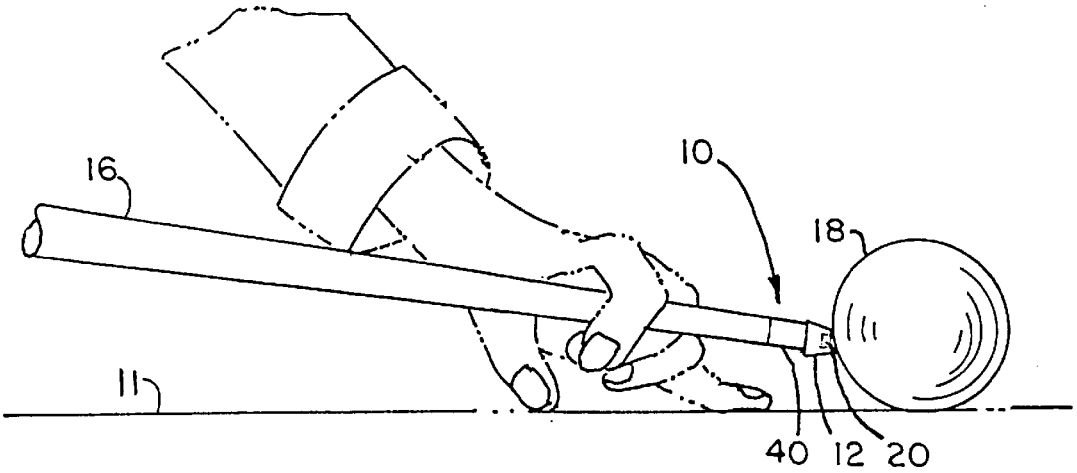
FIG. 1 is a perspective view of the jump tip apparatus installed upon a pool cue.

Referring first to FIG. 1, the jump tip apparatus 10 comprises a striking end 20 having an annular ring 30 of resilient material 12. The annular ring 30 is preferably centered about the longitudinal centerline of the jump tip apparatus 10, which in turn is centered about the longitudinal centerline 14 of the pool cue 16.

Preferably, the striking end 20 of the jump tip apparatus 10 is made of a resilient rubber composition having a shore hardness selected from a range of from 45 to 75. Custom jump tips 10 may be made of selected shore hardness to provide distinct jump tip characteristics to maximize performance and control of the cue ball 18.

The side profile of the jump tip apparatus 10, preferably has a side profile angle 22 tapering from three to twenty degrees from the annular ring 30 striking end 20 towards the ferrule end 40. The side profile angle 22 may be selectively designed to provide distinct performance and control characteristics.

The central portion 24 of the striking end 20 within the annular ring 30 forms a concave depression 26. The diameter and depth of the concave depression 26 and the diameter and thickness of the annular ring 30 are selected to provide distinct performance and control characteristics. The diameter, depth and width of the annular ring 30 formed between the side profile angle 22 and the concave depression 26, together with the shore hardness of the resilient material 12 further serves to provide distinct performance and control characteristics.

Figure 2A:
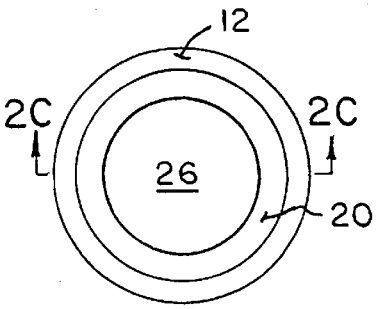
FIG. 2A is a top view of the jump tip apparatus of this invention.
Figure 2B:
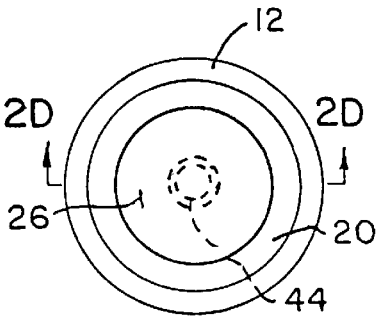
FIG. 2B is a top view of a modified jump tip apparatus.

FIG. 1A shows a plan view for the jump tip apparatus, wherein it incorporates an internally threaded ferrule end. FIG. 2B shows the jump tip apparatus, wherein its threads 44 are externally provided upon its ferrule end.

Figure 2C:
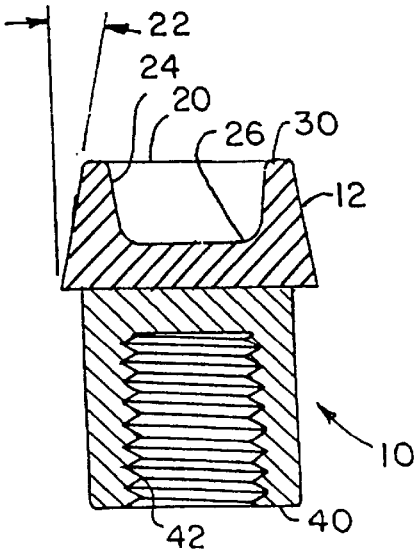
FIG. 2C is a cross-sectional view of the jump tip apparatus, having an internally threaded ferrule end.

As best shown in FIG. 2C, a ferrule end 40 of the jump tip apparatus 10 is located on the end opposite the striking end 20. The ferrule end 40 may be made of a non-resilient plastic or metal composition, and have internal threads 42 sized to be threadably received about the threaded que tip end of a conventional cue stick 16. It is within the scope of this disclosure to selectively provide either internal or external threads sized to threadably engage the threads on the cue tip end of the pool cue 16.

Figure 2D:
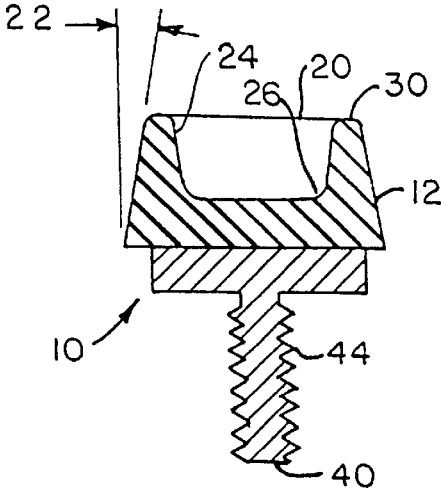
FIG. 2D is a cross-sectional view of the jump tip apparatus, as shown in FIG. 2B, having an externally threaded ferrule end.

External threads 44 are best shown on FIG. 2D. In this embodiment, the conventional cue tip would be threadably disengaged from the end of the cue stick 16, and a customized jump tip apparatus 10 threadably secured upon the threaded striking end of the cue stick 16. With this adaptation, a customized jump tip apparatus 10 would be selected to match the performance characteristics best suited for a particular jump shot, and threadably secured upon the threaded striking end of the cue stick 16, prior to shooting the jump shot.

Upon completion of the jump shot, the customized jump tip apparatus 10 would be removed from the threaded striking end of the cue stick 16, and the conventional cue tip reinstalled upon the striking end of the cue stick 16. Different jump tip apparatus 10 would be selected according to desired performance characteristics, the skill of the user, the intended speed of the cue ball, the distance to be traveled by the cue ball in the air, etc.

Figure 3:
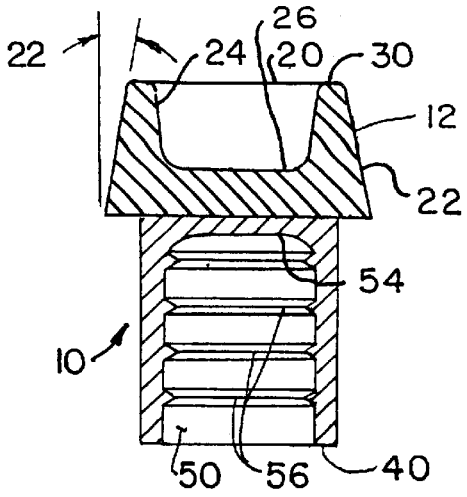
FIG. 3 is an alternate cross sectional view of the jump tip apparatus, wherein the ferrule end comprises an internal aperture having internal ribs.

As best shown in FIG. 3, the ferrule end 40 of the jump tip apparatus 10 may alternately be made with an internal aperture 50 sized to snap onto an existing cue tip on the pool cue 16. The cue tip receiving end of the internal aperture 50 preferably has an internal concave end 54 to ensure mating contact with the cue tip end of the pool cue 16. In this embodiment, internal ribs 56 would preferably be internally positioned to engage the existing cue tip end, to releasably secure the jump tip apparatus 10 thereto without removal of the cue tip from the pool cue 16.

Figure 4:
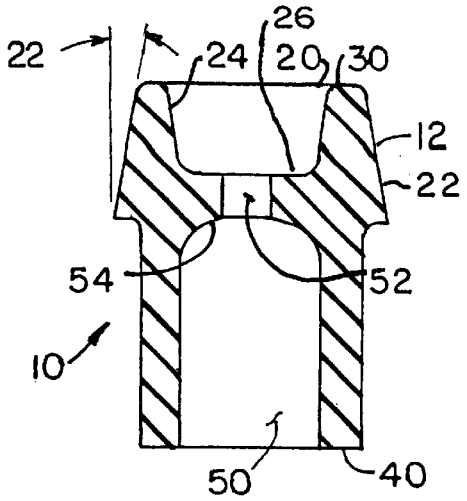
FIG. 4 is an alternate cross sectional view of the jump tip apparatus, wherein the ferrule end is resilient and an internal aperture is sized to be closely received about the tip end of a pool cue.

Alternately, as best shown in FIG. 4, the ferrule end 40 of the jump tip apparatus 10 may be made of a resilient material 12 having an internal aperture 50 sized to be closely received about an existing pool cue. The internal aperture 50 would extend partially towards the striking end 20 of the jump tip apparatus 10.

Preferably, the internal end of the internal aperture 50 would have an internal concave end 54 to ensure mating contact with the cue tip of the pool cue 16. The internal aperture 50 would be sized to be closely received upon the cue tip end of a pool cue 16. Being resilient, the ferrule end 40 of the jump tip apparatus 10 would be removable by twisting and pulling the resilient jump tip apparatus 10 about the cue tip end of the pool cue 16. For best results, the internal aperture 50 would be aligned with the longitudinal central axis 14 of the pool cue 16.

A reduced sized aperture 52 may extend between the internal aperture 50 and the concave depression 26 on the striking end 20 of the jump tip apparatus 10. The reduced sized aperture 52 provides a release for trapped air within the internal aperture 50, when the internal aperture 50 is forced upon the cue tip end of the pool cue, making installation and removal of the jump tip apparatus 10 easier for the user.

Figure 5:
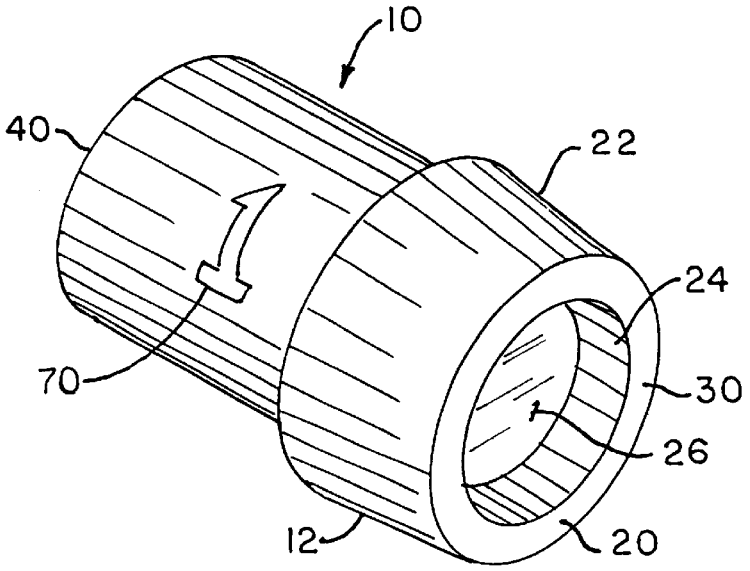
FIG. 5 is a perspective view of the striking end of the jump tip apparatus.

Various selected combinations of jump tip apparatus 10 may be combined in a suitable carrying case (not shown) for ease of transport and storage. Indicia 70 on the carrying case, or on each of the selected jump tip apparatus 10 may be used to identify respective jump tip apparatus 10. The indicia 70 may be in the form of letters, numbers, symbols, shapes or colors to suit manufacturing or user preference. See FIG. 5.

The jump tip apparatus 10 disclosed herein provides significant advantages not previously disclosed in the prior art. The jump tip apparatus 10 allows a player to perform jump shots with a cue ball 18, while striking the cue ball 18 in a conventional manner from a normal pool cue 16 shooting position. The jump tip apparatus 10 enables the user to shoot jump shots, without potential damage to the cloth on the pool or billiard table 11. The jump tip apparatus 10 further allows a player to more easily control the height and length of the jump of a cue ball 18. The jump tip apparatus 10 further allows a player to use "english" in combination with a jump shot. The jump tip apparatus 10 disclosed herein provides selected jump tip configurations, which enables players with less skill to successfully complete selected jump shots with a cue ball 18. The jump tip apparatus 10 disclosed herein is easily installed and removed from a player's favorite pool cue 16 as needed during the normal course of play on a pool or billiard table 11.

Thus, while the present invention has been illustrated and described in connection with certain example embodiments, it will be understood that these are selective embodiments, and are exemplary of the invention, and are not restrictive thereof. It is reasonably to be expected that those skilled in the art can make numerous revisions and adaptions of this invention, and it is intended that such revisions and adaptations be construed as being within the scope of this disclosure, and the accompanying claims.

What is claimed is:

1. A jump tip apparatus for the tip striking end of a pool cue, said jump tip apparatus completely and integrally formed of a resilient material, comprising:

a resilient ferrule end integrally provided forwardly of the jump tip apparatus, said resilient ferrule end having an integral aperture sized to provide a frictionally engaged attachment to the tip end of a pool cue;

a resilient striking end integrally formed of the jump tip apparatus and provided forwardly of the integral resilient ferrule end thereof, said resilent striking end being in longitudinal alignment with the said resilient ferrule end, said striking end having a perimeter formed annular ring at its forward end, and having a concave depression integrally formed within said perimeter of the annular ring;

said perimeter of the annular ring forming the striking end of a pool cue when affixed to its tip end; and at least one air passage extending from the internal aperture of the resilient ferrule end and to the concave depression of the resilient striking end to faciliate the insertion of the jump tip apparatus on to the tip end of a pool cue in preparation for usage.

2. The jump apparatus of claim 1, wherein said resilient striking end has a shore hardness selected from a range from 45 to 75.

3. The jump tip apparatus of claim 1, wherein the air passage comprises at least one cylindrical aperture.

4. The jump tip apparatus of claim 1, and further comprising indicia means for indicating and identifying jump tip characteristics of the jump tip apparatus.

5. The jump tip apparatus of claim 4, wherein the indicia means comprises one or more letters, numbers, symbols, shapes and colors.

6. The jump tip apparatus of claim 1 wherein said jump tip apparatus is for use and application to a pool cue which includes a first tip having a first striking face for striking a cue ball, said jump tip apparatus providing an alternative striking end for the pool cue upon attachment of its resilient ferrule end over the first tip of the said pool cue, said jump tip apparatus attachable to the pool cue and covering at least a portion of its first striking face, the jump tip providing an alternative striking face for striking a cue ball.

7. The jump tip apparatus for the pool cue of claim 6 wherein said alternative striking face includes said concave depression, inwardly of its striking face, and said resilient ferrule end for receiving the first tip of the pool cue.

8. The jump tip apparatus of claim 7 and including a reduced sized aperture extending axially between the concave depression of the striking end and the ferrule end of the jump tip apparatus.

* * * * *